US009260945B2

(12) United States Patent
Lajesic et al.

(10) Patent No.: US 9,260,945 B2
(45) **Date of Patent: *Feb. 16, 2016**

(54) EXPANDABLE AND VARIABLE-LENGTH BULLNOSE ASSEMBLY FOR USE WITH A WELLBORE DEFLECTOR ASSEMBLY

(71) Applicant: Halliburton Energy Services, Inc., Houston, TX (US)

(72) Inventors: Borisa Lajesic, Addison, TX (US); Matthew Bradley Stokes, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 28 days.

This patent is subject to a terminal disclaimer.

(21) Appl. No.: 14/358,805

(22) PCT Filed: Jul. 25, 2013

(86) PCT No.: PCT/US2013/052100

§ 371 (c)(1),
(2) Date: May 16, 2014

(87) PCT Pub. No.: WO2015/012847

PCT Pub. Date: Jan. 29, 2015

(65) Prior Publication Data

US 2015/0267508 A1 Sep. 24, 2015

(51) Int. Cl.

| | |
|---|---|
| ***E21B 23/00*** | (2006.01) |
| ***E21B 41/00*** | (2006.01) |
| ***E21B 23/12*** | (2006.01) |
| ***E21B 7/06*** | (2006.01) |
| ***E21B 19/24*** | (2006.01) |

(52) U.S. Cl.

CPC ..... *E21B 41/0035* (2013.01); *E21B 7/061* (2013.01); *E21B 19/24* (2013.01); *E21B 23/002* (2013.01)

(58) Field of Classification Search

CPC ..... E21B 41/0035; E21B 23/002

See application file for complete search history.

(56) References Cited

U.S. PATENT DOCUMENTS 5,353,876 A 10/1994 Curington et al.
5,454,430 A 10/1995 Kennedy et al.

(Continued)

FOREIGN PATENT DOCUMENTS

WO 2015012847 A1 1/2015

OTHER PUBLICATIONS

International Search Report and Written Opinion for PCT/US2013/052100 dated Apr. 22, 2014.

*Primary Examiner* — Giovanna C Wright

(74) *Attorney, Agent, or Firm* — McDermott Will & Emery LLP; Alan Bryson

(57) ABSTRACT

A wellbore system includes an upper deflector arranged within a main bore of a wellbore and defines first and second channels. A lower deflector is arranged within the main bore and spaced from the upper deflector by a predetermined distance and defines a first conduit exhibiting a predetermined diameter and communicating with a lower portion of the main bore and a second conduit that communicates with a lateral bore. A bullnose assembly includes a body and a bullnose tip arranged at a distal end of the body, the bullnose assembly being actuatable between a default configuration and an actuated configuration. The upper and lower deflectors direct the bullnose assembly into one of the lateral bore and the lower portion of the main bore based on a length and a diameter of the bullnose tip as compared to the predetermined distance and the predetermined diameter, respectively.

21 Claims, 5 Drawing Sheets

(56) References Cited

U.S. PATENT DOCUMENTS

| | | | | |
|---|---|---|---|---|
| 5,526,880 | A | 6/1996 | Jordan, Jr. et al. | |
| 5,533,573 | A * | 7/1996 | Jordan, Jr. et al. | 166/313 |
| 9,140,082 | B2 * | 9/2015 | Lajesic | E21B 17/18 |
| 2005/0115713 | A1 | 6/2005 | Restarick et al. | |
| 2005/0121190 | A1 | 6/2005 | Oberkircher et al. | |
| 2012/0305268 | A1 | 12/2012 | Steele | |
| 2015/0184474 | A1 * | 7/2015 | Lajesic | 166/313 |

* cited by examiner

EXPANDABLE AND VARIABLE-LENGTH BULLNOSE ASSEMBLY FOR USE WITH A WELLBORE DEFLECTOR ASSEMBLY

BACKGROUND

The present disclosure relates generally to multilateral wellbores and, more particularly, to an adjustable bullnose assembly that works with a deflector assembly to allow entry into more than one lateral wellbore of a multilateral wellbore.

Hydrocarbons can be produced through relatively complex wellbores traversing a subterranean formation. Some wellbores include one or more lateral wellbores that extend at an angle from a parent or main wellbore. Such wellbores are commonly called multilateral wellbores. Various devices and downhole tools can be installed in a multilateral wellbore in order to direct assemblies towards a particular lateral wellbore. A deflector, for example, is a device that can be positioned in the main wellbore at a junction and configured to direct a bullnose assembly conveyed downhole toward a lateral wellbore. Depending on various parameters of the bullnose assembly, some deflectors also allow the bullnose assembly to remain within the main wellbore and otherwise bypass the junction without being directed into the lateral wellbore.

Accurately directing the bullnose assembly into the main wellbore or the lateral wellbore can often be a difficult undertaking. For instance, accurate selection between wellbores commonly requires that both the deflector and the bullnose assembly be correctly orientated within the well and otherwise requires assistance from known gravitational forces. Even with correct orientation and known gravitational forces, causing the assembly to be deflected or directed toward the proper wellbore can nonetheless be challenging. For example, conventional bullnose assemblies are typically only able to enter a lateral wellbore at a junction where the design parameters of the deflector correspond to the design parameters of the bullnose assembly. In order to enter another lateral wellbore at a junction having a differently designed deflector, the bullnose assembly must be returned to the surface and changed out with a bullnose assembly exhibiting design parameters corresponding to the differently designed deflector. This process can be time consuming and costly.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to multilateral wellbores and, more particularly, to an adjustable bullnose assembly that works with a deflector assembly to allow entry into more than one lateral wellbore of a multilateral wellbore.

The present disclosure describes exemplary bullnose assemblies that are able to adjust various parameters while downhole such that they are able to selectively enter multiple legs of a multilateral well, all in a single trip downhole. The parameters of the bullnose assembly that may be adjusted while downhole include its length, its diameter, or a combination of both its length and its diameter. By adjusting the length and diameter of a bullnose assembly on demand while downhole, a well operator may be able to intelligently interact with deflector assemblies arranged at multiple junctions in the multilateral well. Each deflector assembly may include upper and lower deflectors spaced from each other by a predetermined distance. At a desired deflector assembly, the bullnose assembly may be actuated to alter its length with respect to the predetermined distance such that it may be deflected or guided as desired either into a lateral bore or further downhole within the main bore. Similarly, the lower deflector of each deflector assembly may include a conduit that exhibits a predetermined diameter. At the desired deflector assembly, the bullnose assembly may be actuated to alter its diameter with respect to the predetermined diameter such that it may be directed either into the lateral bore or further downhole within the main bore. Accordingly, well operators may be able to selectively guide a bullnose assembly into multiple legs of the well by adjusting the parameters of the bullnose assembly on demand while downhole. This may prove advantageous in allowing entry into multiple legs or bores of a multilateral wellbore all in a single trip downhole with a single bullnose assembly.

Figure 1:
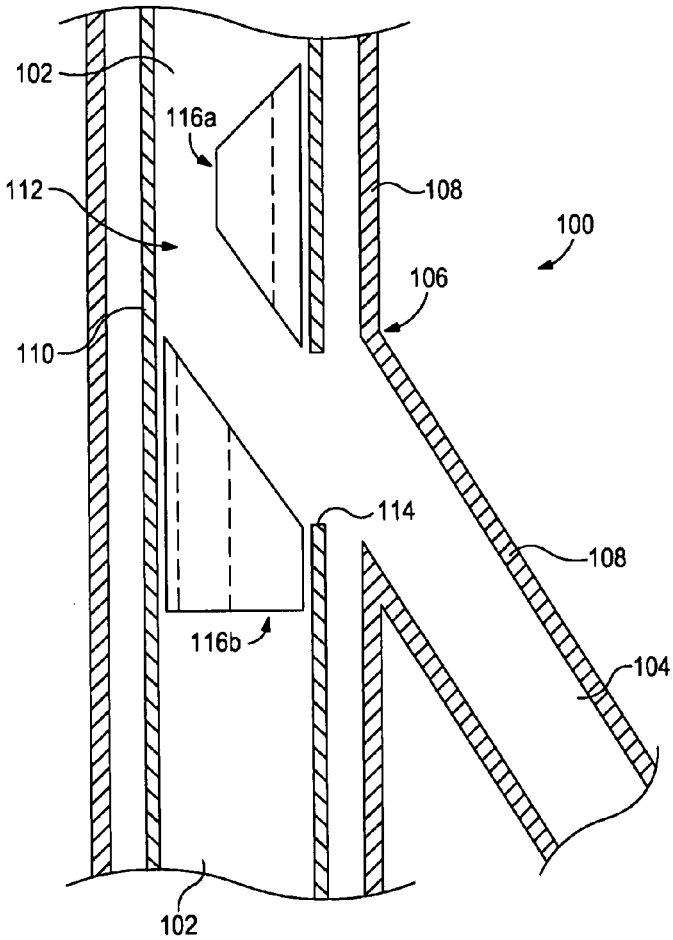
FIG. 1 depicts an exemplary well system that may employ one or more principles of the present disclosure, according to one or more embodiments.

Referring to FIG. 1, illustrated is an exemplary well system 100 that may employ one or more principles of the present disclosure, according to one or more embodiments. The well system 100 includes a main bore 102 and a lateral bore 104 that extends from the main bore 102 at a junction 106 in the well system 100. The main bore 102 may be a wellbore drilled from a surface location (not shown), and the lateral bore 104 may be a lateral or deviated wellbore drilled at an angle from the main bore 102. As used herein, the term "lateral bore" may also refer to a "leg" of the main bore 102 that does not necessarily deviate from the main bore 102 immediately, as shown in FIG. 1, but may do so after traversing some distance within the confines of the main bore 102. While the main bore 102 is shown as being oriented vertically, the main bore 102 may be oriented generally horizontal or at any angle between vertical and horizontal, without departing from the scope of the disclosure.

In some embodiments, the main bore 102 may be lined with a casing string 108 or the like, as illustrated. The lateral bore 104 may also be lined with casing string 108. In other embodiments, however, the casing string 108 may be omitted from the lateral bore 104 such that the lateral bore 104 may be formed as an "open hole" section, without departing from the scope of the disclosure.

In some embodiments, a tubing string 110 may be extended within the main bore 102 and a deflector assembly 112 may be arranged within or otherwise form an integral part of the tubing string 110 at or near the junction 106. The tubing string 110 may be a work string, such as a completion string, extended downhole within the main bore 102 from the surface location and may define or otherwise provide a window 114 therein such that downhole tools or the like may exit the tubing string 110 into the lateral bore 104. In other embodiments, the tubing string 110 may be omitted and the deflector assembly 112 may instead be arranged within the casing string 108 and the casing string 108 may have the window 114 defined therein, without departing from the scope of the disclosure.

As discussed in greater detail below, the deflector assembly 112 may be used to direct or otherwise guide a bullnose assembly (not shown) either further downhole within the main bore 102 or into the lateral bore 104 based on parameters of the bullnose assembly. To accomplish this, the deflector assembly 112 may include a first or upper deflector 116*a* and a second or lower deflector 116*b*. In some embodiments, the upper and lower deflectors 116*a,b* may be secured within the tubing string 110 using one or mechanical fasteners (not shown) or the like. In other embodiments, the upper and lower deflectors 116*a,b* may be welded into place within the tubing string 110, without departing from the scope of the disclosure. In yet other embodiments, the upper and lower deflectors 116*a,b* may form an integral part of the tubing string 110, such as being machined out of bar stock and threaded into the tubing string 110. The upper deflector 116*a* may be arranged closer to the surface (not shown) than the lower deflector 116*b*, and the lower deflector 116*b* may be generally arranged downhole from the upper deflector 116*a*.

Figure 2A:
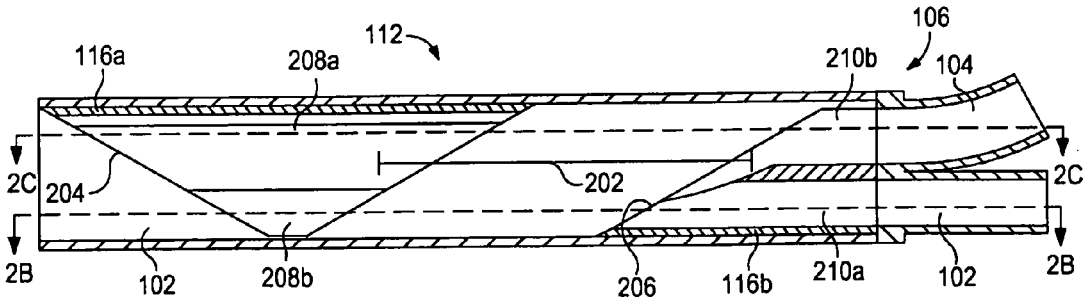
FIGS. 2A-2C depict longitudinal cross-sectional views of the deflector assembly of FIG. 1, according to one or more embodiments.
Figure 2B:
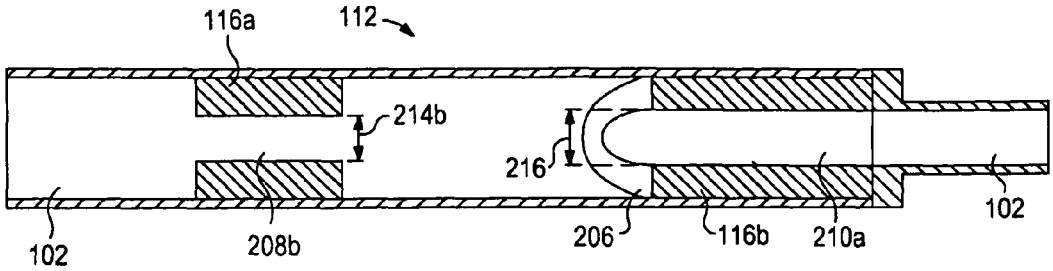
Figure 2C:
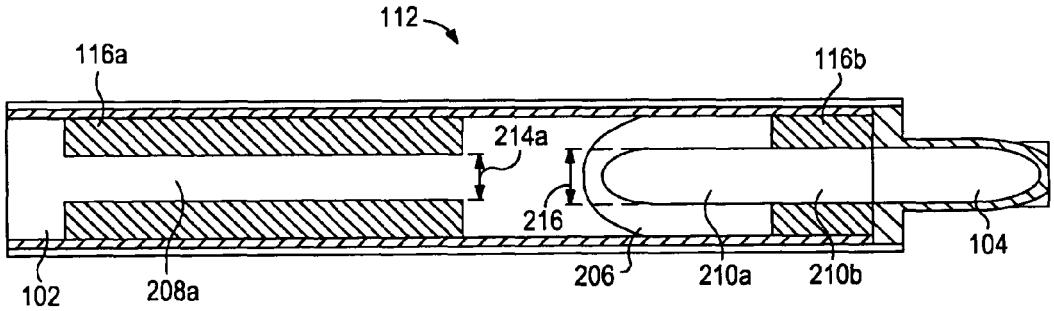

Referring now to FIGS. 2A-2C, with continued reference to FIG. 1, illustrated are longitudinal cross-sectional views of the deflector assembly 112 of FIG. 1, according to embodiments disclosed. As illustrated in FIG. 2A, the upper deflector 116*a* may be spaced from the lower deflector 116*b* by a predetermined distance 202. The upper deflector 116*a* may define or otherwise provide a ramped surface 204 facing the uphole direction within the main bore 102. Similarly, the lower deflector 116*b* may also provide a ramped surface 206 facing the uphole direction and the upper deflector 116*a* within the main bore 102.

The upper deflector 116*a* may further define a first channel 208*a* and a second channel 208*b*, where both the first and second channels 208*a,b* extend longitudinally through the upper deflector 116*a*. The lower deflector 116*b* may define a first conduit 210*a* and a second conduit 210*b*, where at least the first conduit 210*a* extends longitudinally through the lower deflector 116*b* and otherwise communicates with a lower or downhole portion of the parent or main bore 102 past the junction 106. In some embodiments, the second conduit 210*b* may also extend longitudinally through the lower deflector 116*b* and otherwise communicate with the lateral bore 104. However, in other embodiments, the second conduit 210*b* may instead form an integral part or extension of the ramped surface 206 and otherwise serve to guide or direct a bullnose assembly into the lateral bore 104. Accordingly, in at least one embodiment, the deflector assembly 112 may be arranged in a multilateral wellbore system where the lateral bore 104 is only one of several lateral bores that are accessible from the main bore 102 via a corresponding number of deflector assemblies 112 arranged at multiple junctions.

FIGS. 2B and 2C are opposing section views of the deflector assembly 112 taken along the lines indicated in FIG. 2A. More particularly, FIG. 2B is a cross-section of the deflector assembly 112 depicting the second channel 208*b* of the upper deflector 116*a* and the first conduit 210*a* of the lower deflector 116*b*. In contrast, FIG. 2C is a cross-section of the deflector assembly 112 depicting the first channel 208*a* of the upper deflector 116*a* and the second conduit 210*b* of the lower deflector 116*b*. As illustrated, the first channel 208*a* and the second conduit 210*b* are generally axially aligned within the main bore 102, and the second channel 208*b* and the first conduit 210*a* are generally axially aligned within the main bore 102.

As depicted in FIGS. 2B and 2C, the first channel 208*a* may have or otherwise exhibit a first width 214*a* and the second channel 208*b* may exhibit a second width 214*b* larger than the first width 214*a*. Moreover, the first conduit 210*a* may exhibit a predetermined diameter 216 and the second conduit 210*b* may exhibit a diameter or width that is larger than the predetermined diameter 216. These differences are better illustrated in FIGS. 3A and 3B, which depict end views of the upper and lower deflectors 116*a,b*, respectively, according to one or more embodiments.

Figure 3A:
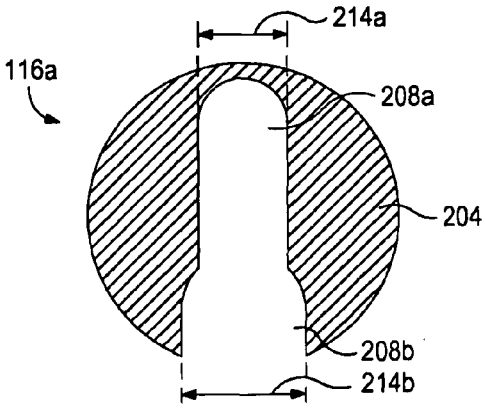
FIGS. 3A and 3B illustrate cross-sectional end views of upper and lower deflectors, respectively, of the deflector assembly of FIGS. 2A-2C, according to one or more embodiments.

In FIG. 3A, the first channel 208*a* and the second channel 208*b* are shown as extending longitudinally through the upper deflector 116*a*. The first channel 208*a* exhibits the first width 214*a* and the second channel 208*b* exhibits the second width 214*b*. As depicted, the first width 214*a* is less than the second width 214*b*. As a result, bullnose assemblies exhibiting a diameter larger than the first width 214*a* but smaller than the second width 214*b* may be able to extend through the upper deflector 116*a* via the second channel 208*b* and otherwise bypass the first channel 208*a*. In such embodiments, the bullnose assembly may slidingly engage the ramped surface 204 (FIG. 2) until being directed into the second channel 208*b*. Alternatively, bullnose assemblies exhibiting a diameter smaller than the first width 214*a* may be able to pass through the upper deflector 116*a* via either the first or second channels 208*a,b*.

Figure 3B:
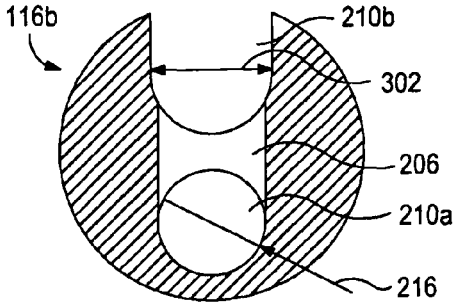

In FIG. 3B, the first and second conduits 210*a,b* are shown as extending longitudinally through the lower deflector 116*b*. As mentioned above, however, in at least one embodiment, the ramped surface 206 may extend to or form part of the second conduit 210*b* such that the second conduit 210*b* does not necessarily extend through the lower deflector 116*b* but instead serves as a ramped deflecting or guiding surface for the lateral bore 104. The first conduit 210*a* exhibits the predetermined diameter 216 and, as depicted, the second conduit 210*b* may exhibit a diameter 302 that is larger than the predetermined diameter 216. As a result, bullnose assemblies exhibiting a diameter larger than the predetermined diameter 216 are prevented from entering the first conduit 210*a* and are instead directed to the second conduit 210*b* via the ramped surface 206. In such embodiments, the bullnose assembly may slidingly engage the ramped surface 206 until entering the second conduit 210*b* or otherwise being directed into the lateral bore 104 (FIGS. 2A-2C) via the second conduit 210*b*. Alternatively, bullnose assemblies exhibiting a diameter smaller than the predetermined diameter 216 are able to extend through the first conduit 210*a* and into lower portions of the lower main bore 102.

Referring again to FIGS. 2A-2C, with continued reference to FIGS. 3A and 3B, the deflector assembly 112 may be useful in directing a bullnose assembly (not shown) into the lower portions of the main bore 102 or the lateral bore 104 based on structural parameters of the bullnose assembly. For instance, the deflector assembly 112 may be useful in directing a bullnose assembly into the lateral bore 104 via the second conduit 210*b* based on at least a length of the bullnose assembly. More particularly, bullnose assemblies that are shorter than the predetermined distance 202 may be able to be directed into the lateral bore 104 via the second conduit 210*b*. Otherwise, bullnose assemblies that are longer than the predetermined distance 202 may instead be directed further downhole in the main bore 102 via the first conduit 210*a*.

Moreover, the deflector assembly 112 may be useful in directing a bullnose assembly (not shown) into the lower portions of the main bore 102 or the lateral bore 104 based on a diameter of the bullnose assembly. For instance, bullnose assemblies having a diameter smaller than the predetermined diameter 216 may be directed into the first conduit 210*a* and subsequently to lower portions of the main bore 102. In contrast, bullnose assemblies that have a diameter greater than the predetermined diameter 216 will slidingly engage the ramped surface 206 until locating the second conduit 210*b* and otherwise being directed into the lateral bore 104.

Figure 4A:
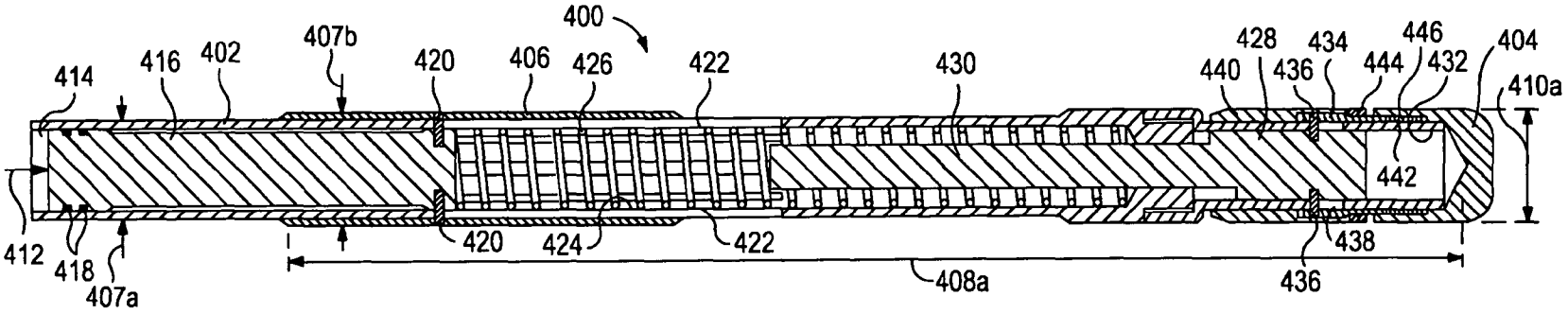
FIGS. 4A and 4B illustrate cross-sectional side views of an exemplary bullnose assembly, according to one or more embodiments.
Figure 4B:
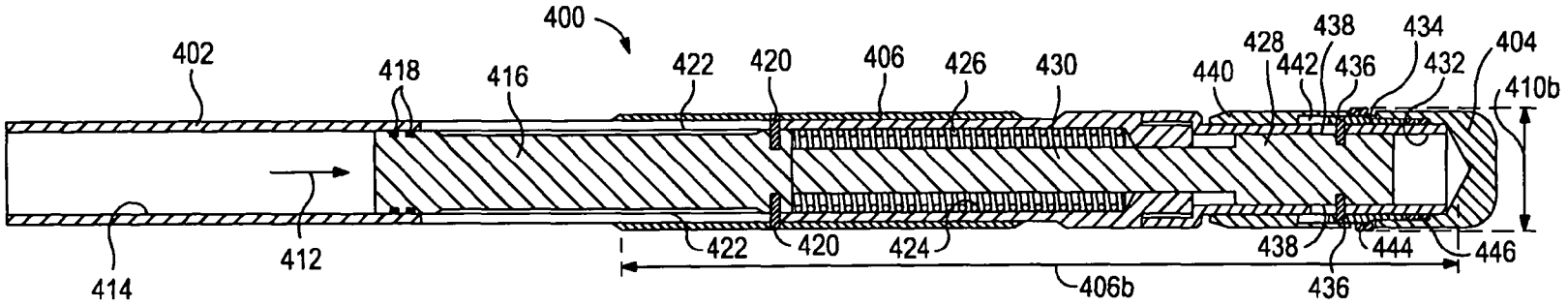

In yet other embodiments, the deflector assembly 112 may be useful in directing a bullnose assembly into the lower portions of the main bore 102 or the lateral bore 104 based on both the length and the diameter of the bullnose assembly. Referring now to FIGS. 4A and 4B, illustrated are cross-sectional side views of an exemplary bullnose assembly 400, according to one or more embodiments. The bullnose assembly 400 may constitute the distal end of a tool string (not shown), such as a bottom hole assembly or the like, that is conveyed downhole within the main bore 102 (FIG. 1). In some embodiments, the bullnose assembly 400 is conveyed downhole using coiled tubing (not shown). In other embodiments, however, the bullnose assembly 400 may be conveyed downhole using other types of conveyances such as, but not limited to, drill pipe, production tubing, or any other conveyance capable of being fluidly pressurized. In yet other embodiments, the bullnose assembly 400 may be conveyed downhole using wireline, slickline, electrical line, or the like, without departing from the scope of the disclosure. The tool string may include various downhole tools and devices configured to undertake various wellbore operations once accurately placed in the downhole environment, and the bullnose assembly 400 may be configured to accurately guide the tool string such that it reaches its target destination, e.g., the lateral bore 104 of FIG. 1 or further downhole within the main bore 102.

To accomplish this, the bullnose assembly 400 may include a body 402 and a bullnose tip 404 coupled or otherwise attached to the distal end of the body 402. In some embodiments, the bullnose tip 404 may form part of the body 402 as an integral extension thereof. As illustrated, the bullnose tip 404 may be rounded off at its end or otherwise angled or arcuate such that it does not present sharp corners or angled edges that might catch on portions of the main bore 102 or the deflector assembly 112 (FIG. 1) as it is extended downhole.

The bullnose assembly 400 may further include a sleeve member 406 arranged about a portion of the body 402. The body 402 may exhibit a first diameter 407*a* that is less than the width 214*a* of the first channel 208*a*, and the sleeve member 406 may exhibit a second diameter 407*b* that is greater than the first diameter 407*a* and also greater than the width 214*a* of the first channel 208*a*. In some embodiments, the sleeve member 406 may be configured to be actuated such that it moves axially with respect to the bullnose tip 404, and thereby effectively alters the overall length of the bullnose tip 404. As will be discussed below, however, in some embodiments, the sleeve member 406 may instead be a stationary component of the bullnose assembly 400 and the bullnose tip 404 may axially move with respect to the sleeve member 406 in order to adjust the length of the bullnose tip 404, without departing from the scope of the disclosure.

As used herein, the phrase "length of the bullnose tip" refers to the axial length of the bullnose assembly 400 that encompasses the axial length of both the bullnose tip 404 and the sleeve member 406. When the sleeve member 406 is arranged distally from the bullnose tip 404, as described below, the "length of the bullnose tip" further refers to the combined axial lengths of both the bullnose tip 404 and the sleeve member 406 and any distance that separates the two components.

FIG. 4A depicts the bullnose assembly 400 in a default configuration, and FIG. 4B depicts the bullnose assembly 400 in an actuated configuration. In the default configuration, the sleeve member 406 is arranged distally from the bullnose tip 404 such that the bullnose tip 404 effectively exhibits a first length 408*a*, where the first length 408*a* is greater than the predetermined distance 202 (FIG. 2A) between the upper and lower deflectors 116*a,b* of the deflector assembly 112 (FIGS. 1 and 2A-2C). In the actuated configuration, the sleeve member 406 is moved generally adjacent the bullnose tip 404 such that the bullnose tip 404 effectively exhibits a second length 408*b* that incorporates the axial lengths of both the bullnose tip 404 and the sleeve member 406. As illustrated, the second length 408*b* is less than the first length 408*a*, but the second length 408*b* is also less than the predetermined distance 202 (FIG. 2A).

Moreover, in the default configuration (FIG. 4A), the bullnose tip 404 of the bullnose assembly 400 exhibits a first diameter 410*a* that is less than the predetermined diameter 216 (FIGS. 2B, 2C, and 3B) of the first conduit 210*a* and may be substantially similar to the diameter 407*b* of the sleeve member 406. Consequently, when the bullnose assembly 400 is in the default configuration, it may be sized such that it is able to extend into the first conduit 210*a* and into lower portions of the main bore 102. In contrast, in the actuated configuration (FIG. 4B), the bullnose tip 404 exhibits a second diameter 410*b*, where the second diameter 410*b* is greater than the first diameter 410*a* and also greater than the predetermined diameter 216. Consequently, when the bullnose assembly 400 is in the actuated configuration it is prevented from entering the first conduit 210*a* but is instead directed into the second conduit 210*b* via the ramped surface 206 (FIGS. 2A-2C and 3B) and subsequently into the lateral bore 104.

In order to move the bullnose assembly 400 from its default configuration (FIG. 4A) into its actuated configuration (FIG. 4B), the bullnose assembly 400 may be actuated. In some embodiments, actuating the bullnose assembly 400 involves applying hydraulic pressure to the bullnose assembly 400. More particularly, a hydraulic fluid 412 may be applied from a surface location, through the conveyance (i.e., coiled tubing, drill pipe, production tubing, etc.) coupled to the bullnose assembly 400, and from the conveyance to the interior of the bullnose assembly 400. At the bullnose assembly 400, the hydraulic fluid 412 enters the body 402 via a hydraulic conduit 414 and acts on the end of a first piston 416. One or more sealing elements 418 (two shown), such as O-rings or the like, may be arranged between the first piston 416 and the inner surface of the hydraulic conduit 414 such that a sealed engagement results.

The first piston 416 may be operatively coupled to the sleeve member 406 such that movement of the first piston 416 correspondingly moves the sleeve member 406. In the illustrated embodiment, one or more coupling pins 420 (two shown) may operatively couple the first piston 416 to the sleeve member 406 and extend between the first piston 416 and the sleeve member 406 through corresponding longitudinal grooves 422.

In other embodiments, however, the first piston 416 may be operatively coupled to the sleeve member 406 using any other device or coupling method known to those skilled in the art. For example, in at least one embodiment, the first piston 416 and the sleeve member 406 may be operatively coupled together using magnets (not shown). In such embodiments, one magnet may be installed in the first piston 416 and a corresponding magnet may be installed in the sleeve member 406. The magnetic attraction between the two magnets may be such that movement of one urges or otherwise causes corresponding movement of the other.

The hydraulic fluid 412 acts on the first piston 416 such that it moves distally (i.e., to the right in FIGS. 4A and 4B) within the hydraulic conduit 414 and into a first piston chamber 424 defined within the body 402. In some embodiments, the hydraulic conduit 414 and the first piston chamber 424 may be the same, and the first piston 416 may be configured to translate axially therein. As the first piston 416 moves axially into the first piston chamber 424, the sleeve member 406 correspondingly moves axially since it is operatively coupled thereto. In the illustrated embodiment, as the first piston 416 moves, the coupling pins 420 translate axially within the longitudinal grooves 422 and thereby move the sleeve member 406 in the same direction. Moreover, as the first piston 416 moves, it engages a first biasing device 426 arranged within the first piston chamber 424 and compresses the first biasing device 426 such that a spring force is generated therein. In some embodiments, the first biasing device 426 may be a helical spring or the like. In other embodiments, the first biasing device 426 may be a series of Belleville washers, an air shock or gas chamber, or the like, without departing from the scope of the disclosure.

As the first piston 416 moves axially in the first piston chamber 424, it may also come into contact with and otherwise engage the proximal end of a second piston 428 such that the second piston 428 is correspondingly moved. More particularly, the first piston 416 may engage the proximal end of a piston rod 430 that extends longitudinally from the second piston 428. The second piston 428 may be movably arranged within a second piston chamber 432 defined within the bullnose tip 404. The second piston 428 may be operatively coupled to a wedge member 434 disposed about the body 402 such that movement of the second piston 428 correspondingly moves the wedge member 434. In the illustrated embodiment, one or more coupling pins 436 (two shown) may operatively couple the second piston 428 to the wedge member 434. More particularly, the coupling pins 436 may extend between the second piston 428 and the wedge member 434 through corresponding longitudinal grooves 438. In other embodiments, however, the second piston 428 may be operatively coupled to the wedge member 434 using any other device or coupling method known to those skilled in the art, such as the magnets described above.

The bullnose tip 404 may further include an end ring 440 that forms part of or otherwise may be characterized as an integral part of the bullnose tip 404. Accordingly, the bullnose tip 404 and the end ring 440 may cooperatively define the "bullnose tip." The wedge member 434 may be movably arranged within a wedge chamber 442 defined at least partially between the end ring 440 and the bullnose tip 404 and the outer surface of the second piston chamber 432. In operation, the wedge member 434 may be configured to move axially within the wedge chamber 442.

The bullnose assembly 400 may further include a coil 444 that may be arranged within a gap defined axially between the end ring 440 and the bullnose tip 404 and otherwise sitting on or engaging a portion of the wedge member 434. The coil 444 may be, for example, a helical coil or a helical spring that has one or more wraps or revolutions. In other embodiments, however, the coil 444 may be a series of snap rings or the like. In the illustrated embodiment, two wraps or revolutions of the coil 444 are shown, but it will be appreciated that more than two wraps (or a single wrap) may be employed, without departing from the scope of the disclosure. In the default configuration (FIG. 4A), the coil 444 sits generally flush with the outer surface of the bullnose tip 404 such that it also generally exhibits the first diameter 410*a*.

With reference to FIG. 4B, as the first piston 416 moves axially and engages the proximal end of the second piston 428 (e.g., via the piston rod 430), the second piston 428 is urged in the same direction within the second piston chamber 432. As the second piston 428 translates axially within the second piston chamber 432, the wedge member 434 correspondingly moves axially since it is operatively coupled thereto. In the illustrated embodiment, as the second piston 428 moves, the coupling pins 436 translate axially within the corresponding longitudinal grooves 438 and thereby move the wedge member 434 in the same direction.

As the wedge member 434 axially advances within the wedge chamber 442, it may compress a second biasing device 446 arranged within the wedge chamber 442 as it translates axially. Similar to the first biasing device 426, the second biasing device 446 may be a helical spring, a series of Belleville washers, an air shock or a gas chamber, or the like. As described below, the second biasing device 446 does not necessarily have to be in the wedge chamber, but may equally be arranged within the second piston chamber 432, without departing from the scope of the disclosure. Moreover, as the wedge member 434 axially advances within the wedge chamber 442, it engages the coil 444 and forces the coil 444 radially outward to the second diameter 410*b*. As a result, the bullnose assembly 400 is moved to its actuated configuration where the bullnose tip 404 effectively exhibits the second diameter 410*b*.

Once it is desired to return the bullnose assembly 400 to its default configuration, the hydraulic pressure on the bullnose assembly 400 may be released. Upon releasing the hydraulic pressure, the spring force built up in the first biasing device 426 may serve to force the first piston 416 (and therefore the sleeve member 406) back to the default position shown in FIG. 4A, and thereby effectively return the bullnose tip 404 to the first length 408*a*. Moving the first piston 416 back to the default configuration also allows the second piston 428 to move back to its default position shown in FIG. 4A. More particularly, the second biasing device 446 may force the wedge member 434 back within the wedge chamber 442, thereby correspondingly moving the second piston 428 and allowing the coil 444 to radially contract to the position shown in FIG. 4A. As a result, the bullnose tip 404 may be effectively returned to the first diameter 410*a*. As will be appreciated, such an embodiment allows a well operator to decrease the length and increase the diameter of the bullnose tip 404 on demand while downhole simply by applying pressure through the conveyance and to the bullnose assembly 400.

Those skilled in the art will readily recognize that several other methods may equally be used to actuate the bullnose assembly 400 between the default and actuated configurations. For instance, although not depicted herein, the present disclosure also contemplates using one or more actuating devices to physically adjust the axial position of the sleeve member 406 and/or the wedge member 434 and thereby lengthen the bullnose assembly 400 and/or increase its diameter. Such actuating devices may include, but are not limited to, mechanical actuators, electromechanical actuators, hydraulic actuators, pneumatic actuators, combinations thereof, and the like. Such actuators may be powered by a downhole power unit or the like, or otherwise powered from the surface via a control line or an electrical line. The actuating device (not shown) may be operatively coupled to the sleeve member 406 and/or the wedge member 434 and configured to correspondingly move the sleeve member 406 and/or the wedge member 434 axially. Otherwise, the actuating device(s) may be coupled to the first and second pistons 416, 428 to equally achieve the same results.

In yet other embodiments, the present disclosure further contemplates actuating the bullnose assembly 400 by using fluid flow around the bullnose assembly 400. In such embodiments, one or more ports (not shown) may be defined through the body 402 and/or the bullnose tip 404 such that at least one of the first piston chamber 424 and the second piston chamber 432 is placed in fluid communication with the fluids outside the bullnose assembly 400. A fluid restricting nozzle may be arranged in one or more of the ports such that a pressure drop is created across the bullnose assembly 400. Such a pressure drop may be configured to force at least one of the first and second pistons 416, 428 toward the actuated configuration (FIG. 4B) and correspondingly move the sleeve member 406 and the wedge member 434 in the same direction. In yet other embodiments, hydrostatic pressure may be applied across the bullnose assembly 400 to achieve the same end.

While the bullnose assembly 400 described above depicts the bullnose tip 404 as moving between the first and second diameters 410*a,b*, where the first diameter is less than the predetermined diameter 216 and the second diameter is greater than the predetermined diameter 216, the present disclosure further contemplates embodiments where the dimensions of the first and second diameters 410*a,b* are reversed. More particularly, the present disclosure further contemplates embodiments where the bullnose tip 404 in the default configuration may exhibit a diameter greater than the predetermined diameter 216 and may exhibit a diameter less than the predetermined diameter 216 in the actuated configuration, without departing from the scope of the disclosure. Accordingly, actuating the bullnose assembly 400 may entail a reduction in the diameter of the bullnose tip 404, without departing from the scope of the disclosure.

Moreover, while the bullnose assembly 400 described above depicts the bullnose tip 404 as moving between the first and second lengths 408*a,b*, where the first length is greater than the predetermined length 202 and the second length is less than the predetermined length 202, the present disclosure further contemplates embodiments where the dimensions of the first and second lengths 408*a,b* are reversed. More particularly, the present disclosure further contemplates embodiments where the bullnose tip 404 in the default configuration may exhibit a length less than the predetermined length 202 and may exhibit a length greater than the predetermined length 202 in the actuated configuration, without departing from the scope of the disclosure. Accordingly, actuating the bullnose assembly 400 may entail an expansion in the length of the bullnose tip 404, without departing from the scope of the disclosure.

Figure 5:
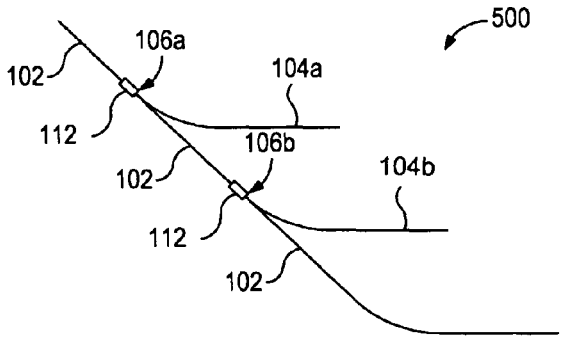
FIG. 5 illustrates an exemplary multilateral wellbore system that may implement the principles of the present disclosure.

Referring now to FIG. 5, with continued reference to the preceding figures, illustrated is an exemplary multilateral wellbore system 500 that may implement the principles of the present disclosure. The wellbore system 500 may include the main bore 102 that extends from a surface location (not shown) and passes through at least two junctions 106, shown as a first junction 106*a* and a second junction 106*b*. While two junctions 106*a,b* are shown in the wellbore system 500, it will be appreciated that more than two junctions 106*a,b* may be utilized, without departing from the scope of the disclosure.

At each junction 106*a,b*, a lateral bore 104 (shown as first and second lateral bores 104*a* and 104*b*, respectively) extends from the main bore 102. The deflector assembly 112 described above with reference to FIGS. 2A-2C may be arranged at each junction 106*a,b*. Accordingly, each junction 106*a,b* includes a deflector assembly 112 having upper and lower deflectors 116*a,b* that are spaced from each other by the predetermined distance 202 (FIG. 2A), and where the lower deflector 116*b* at each junction 106*a,b* includes a first conduit 210*a* exhibiting the predetermined diameter 216 (FIG. 2A).

In one or more embodiments, the bullnose assembly 400 of FIGS. 4A and 4B may be introduced into the wellbore system 500 and able to enter any of the legs of the wellbore by moving between the default and actuated configurations, as described above. More particularly, upon encountering each junction 106*a,b*, the bullnose assembly 400 may have the option of either entering the lateral bore 104*a,b* at that junction 106*a,b* or passing through the junction 106*a,b* and otherwise extending into the lower portions of the main bore 102 therebelow. As will be appreciated, because of the design of the deflector assemblies 112 and the actuatable configuration of the bullnose assembly 400, guiding the bullnose assembly 400 into any lateral bore 104*a,b* or lower portions of the main bore 102 is not dependent on gravitational forces or orientation of the bullnose assembly 400 while downhole.

Upon encountering the first junction 106*a* in the default configuration, for example, the bullnose assembly 400 may be directed into the lower portions of the main bore 102 via the first conduit 210*a*. This is possible since, in the default configuration, the first length 408*a* (FIG. 4A) spans the predetermined distance 202 (FIG. 2A) between the upper and lower deflectors 116*a,b* and the width 407*b* of the sleeve member 406 is greater than the width 214*a* of the first channel 208*a*. As a result, the bullnose assembly 400 is generally prevented from moving laterally within the main bore 102 into the first channel 208*a* and otherwise aligning with the second conduit 210*b* of the lower deflector 116*b*. Rather, the bullnose tip 404 is received by the first conduit 210*a* while at least a portion of the sleeve member 406 remains supported in the second channel 208*b* of the upper deflector 116*a*. Moreover, in the default configuration, the diameter 410*a* of the bullnose assembly 400 is less than the predetermined diameter 216 (FIGS. 2B, 2C, and 3B) of the first conduit 210*a*. As a result, the bullnose tip 404 may be able to extend into the first conduit 210*a* and thereby guide the bullnose assembly 400 downhole to lower portions of the main bore 102.

Alternatively, the bullnose assembly 400 may be actuated prior to encountering the first junction 106*a* and thereby be directed into the first lateral bore 104*a* via the second conduit 210*b*. This is possible since the second diameter 410*b* of the bullnose tip 404 is greater than the predetermined diameter 216 of the first conduit 210*a*. As a result, upon encountering the lower deflector 116*b* in the actuated configuration, the bullnose tip 404 is prevented from entering the first conduit 210*a* but instead slidingly engages the ramped surface 206 until entering the second conduit 210*b* and otherwise being introduced into the first lateral bore 104*a*. This is further possible since, in the actuated configuration, the length 408*b* of the bullnose tip 404 is less than the predetermined distance 202. As a result, the bullnose tip 404 and the sleeve member 406 will eventually exit the second channel 208*b* and thereby no longer be supported therein and may instead fall into or otherwise be received by the first channel 208*a* which aligns axially with the second conduit 210*b*.

After passing through the first junction 106*a* in the multilateral wellbore system 500 of FIG. 5, as generally described above, the bullnose assembly 400 may then be advanced further within the main bore 102 until interacting with and otherwise being deflected by the second deflector assembly 112 arranged at the second junction 106*b*. Similar to the first junction 106*a*, the bullnose assembly 400 at the second junction 106*b* may have the option of either entering the second lateral bore 104*b* or passing through the second junction 106*b* and otherwise extending into the lower portions of the main bore 102 therebelow. As described above, either direction may be accomplished by moving the bullnose assembly 400 between the default and actuated configurations.

If entry into the lower portions of the main bore 102 below the second junction 106*b* (FIG. 5) is desired, the bullnose assembly 400 may be extended through the second junction 106*b* in the default configuration, as described above, and it will enter the main bore 102 below the second junction 106*b*. Again, this is possible since the first length 408*a* (FIG. 4A) spans the predetermined distance 202 (FIG. 2A) between the upper and lower deflectors 116*a,b*, thereby preventing the bullnose assembly 400 from entering into the first channel 208*a* and axially aligning with the second conduit 210*b*. This is also possible since the first conduit 210*a* exhibits the predetermined diameter 216 (FIGS. 2B, 2C, and 3B) that is greater than the diameter 410*a* (FIG. 4A) of the bullnose tip 404 while in the default configuration and can therefore guide the bullnose assembly 400 downhole to lower portions of the main bore 102.

Figure 6A:
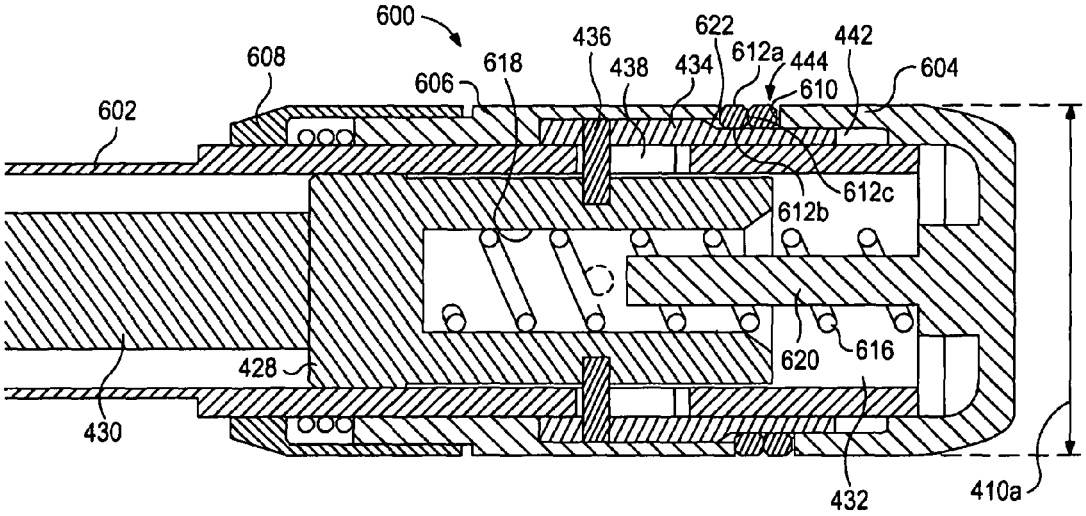
FIGS. 6A and 6B illustrate cross-sectional side views of another exemplary bullnose assembly, according to one or more embodiments.
Figure 6B:
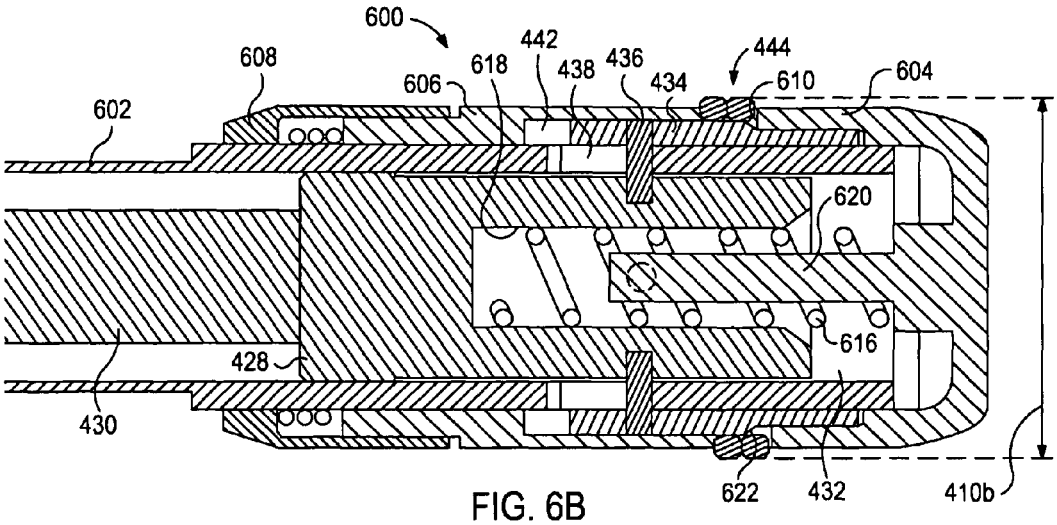

Referring now to FIGS. 6A and 6B, illustrated are cross-sectional side views of a portion of another exemplary bullnose assembly 600, according to one or more embodiments. More particularly, illustrated is an exemplary bullnose tip 604 similar to the bullnose tip 404 described above with reference to FIGS. 4A and 4B. Accordingly, the bullnose tip 604 may be best understood with reference thereto, where like numerals represent like elements not described again in detail. The bullnose tip 604 may replace the bullnose tip 404 in the bullnose assembly 400, without departing from the scope of the disclosure.

As illustrated, the bullnose assembly 600 may include a body 402 and the bullnose tip 604 is coupled or otherwise attached to the distal end of the body 402. The bullnose assembly 600 is shown in FIG. 6A in a default configuration where the bullnose tip 604 exhibits the first diameter 410*a*. In FIG. 6B, the bullnose assembly 600 is shown in the actuated configuration where the bullnose tip 604 exhibits the second diameter 410*b*. Also illustrated are the second piston 428 movably arranged within the second piston chamber 432 and the piston rod 430 extending axially therefrom.

The second piston 428 is operatively coupled to the wedge member 434 via the one or more coupling pins 436 (two shown) that extend between the second piston 428 and the wedge member 434 through the longitudinal grooves 438. Again, the second piston 428 may be operatively coupled to the wedge member 434 using any other device or coupling method known to those skilled in the art, such as magnets, as described above.

The bullnose tip 604 may include a sleeve 606 and an end ring 608, where the sleeve 606 and the end ring 608 may form part of or otherwise may be characterized as an integral part of the bullnose tip 604. Accordingly, the bullnose tip 604, the sleeve 606, and the end ring 608 may cooperatively define the "bullnose tip." As illustrated, the sleeve 606 generally interposes the end ring 608 and the bullnose tip 604. The wedge member 434 is secured about the body 402 between the sleeve 606 and the bullnose tip 604 and is movably arranged within the wedge chamber 442 defined at least partially between the sleeve 606 and the bullnose tip 604 and the outer surface of the body 402.

The coil 444 is depicted as being wrapped about the bullnose tip 604. More particularly, the coil 444 may be arranged within a gap 610 defined between the sleeve 606 and the bullnose tip 604 and otherwise sitting on or engaging a portion of the wedge member 434. In some embodiments, the outer radial surface 612*a* of each wrap of the coil 444 may be generally planar, as illustrated. The inner radial surface 612*b* and the axial sides 612*c* of each wrap of the coil 444 may also be generally planar, as also illustrated. As will be appreciated, the generally planar nature of the coil 444, and the close axial alignment of the sleeve 606 and the bullnose tip 604 with respect to the coil 444, may prove advantageous in preventing the influx of sand or debris into the interior of the bullnose tip 604.

Referring to FIG. 6B, the bullnose assembly 600 may be actuated using hydraulic forces that transfer to the second piston 428 via the piston rod 430 and the first piston 416 (FIGS. 4A and 4B), as generally described above. As a result, the second piston 428 axially translates within the second piston chamber 432 towards the distal end of the bullnose tip 604 (i.e., to the right in FIGS. 6A and 6B). One or more sealing elements 614 (two shown), such as O-rings or the like, may be arranged between the second piston 428 and the inner surface of the second piston chamber 432 such that a sealed engagement at that location results.

As the second piston 428 translates axially within the second piston chamber 432, it engages a biasing device 616 arranged within the second piston chamber 432. The biasing device 616 may be a helical spring, a series of Belleville washers, an air shock, a gas chamber, or the like. In some embodiments, the second piston 428 may define a cavity 618 that receives at least a portion of the biasing device 616 therein. Moreover, the bullnose tip 604 may also define or otherwise provide a stem 620 that extends axially from the distal end of the bullnose tip 604 in the uphole direction (i.e., to the left in FIGS. 6A and 6B). The stem 620 may also extend at least partially into the cavity 618. The stem 620 may also be extended at least partially through the biasing device 616 in order to maintain an axial alignment of the biasing device 616 with respect to the cavity 618 during operation. As the second piston 428 translates axially within the second piston chamber 432, the biasing device 616 is compressed and generates spring force.

Moreover, as the second piston 428 translates axially within the second piston chamber 432, the wedge member 434 correspondingly moves axially in the same direction within the wedge chamber 442. The wedge member 434 engages the coil 444 at a beveled surface 622 that forces the coil 444 radially outward to the second diameter 410*b*. Once it is desired to return the bullnose assembly 600 to its default configuration, the hydraulic pressure on the bullnose assembly 600 may be released. As a result, the spring force built up in the biasing device 616 may force the second piston 428 back to its default position, thereby correspondingly moving the wedge member 434 and allowing the coil 444 to radially contract to the position shown in FIG. 3A and effectively returning the bullnose tip 604 to the first diameter 410*a*.

Besides using hydraulic forces, those skilled in the art will readily recognize that several other methods or devices may equally be used to actuate the bullnose assembly 600 between the default configuration (FIG. 6A) and the actuated configuration (FIG. 6B). For instance, although not depicted herein, the present disclosure also contemplates using one or more actuating devices to actuate the bullnose assembly 600. In other embodiments, bullnose assembly 600 may be actuated using a pressure drop created across the bullnose assembly 600, as generally described above. In yet other embodiments, hydrostatic pressure may be applied across the bullnose assembly 600 to achieve the same end.

Figure 7A:
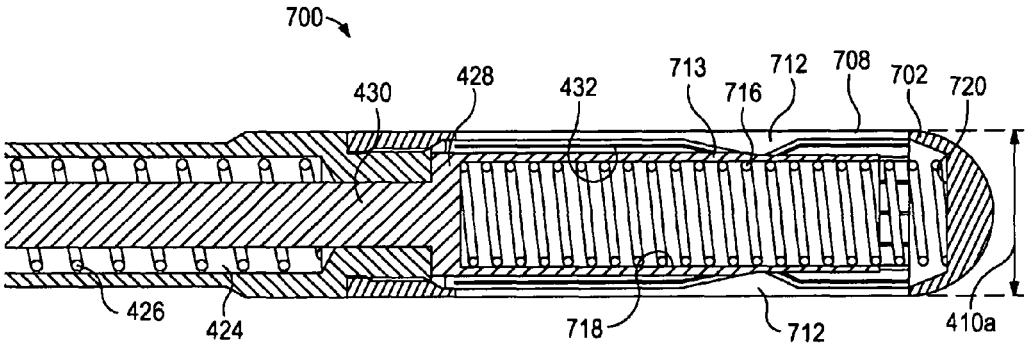
FIGS. 7A and 7B illustrate cross-sectional side views of another exemplary bullnose assembly, according to one or more embodiments.
Figure 7B:
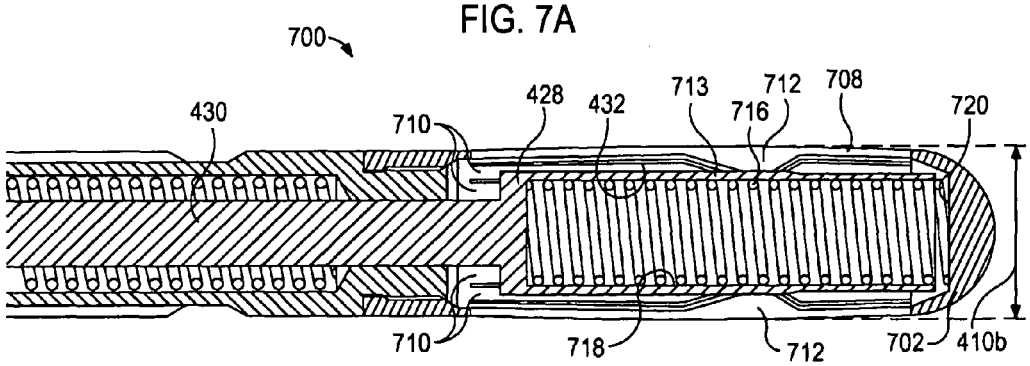

Referring now to FIGS. 7A and 7B, illustrated are cross-sectional side views of another exemplary bullnose assembly 700, according to one or more embodiments. The bullnose assembly 700 may be similar in some respects to the bullnose assemblies 400 and 600 of FIGS. 4A-4B and FIGS. 6A-6B, respectively, and therefore may be best understood with reference thereto. Similar to the bullnose assemblies 400 and 600, the bullnose assembly 700 may be configured to accurately guide a tool string or the like downhole such that it reaches its target destination, e.g., the lateral bore 104 of FIG. 1 or further downhole within the main bore 102. Moreover, similar to the bullnose assemblies 400 and 600, the bullnose assembly 700 may be able to alter its diameter such that it is able to interact with the deflector assembly 112 and thereby selectively determine which path to follow (e.g., the main bore 102 or a lateral bore 104).

The bullnose assembly 700 is shown in FIG. 7A in its default configuration where a bullnose tip 702 exhibits the first diameter 410*a*. In FIG. 7B, the bullnose assembly 700 is shown in its actuated configuration where the bullnose tip 702 exhibits the second diameter 410*b*. In order to move between the default and actuated configurations, the bullnose assembly 700 may include the second piston 428 movably arranged within the second piston chamber 432 and the piston rod 430 extending axially therefrom through the first piston chamber 424.

The second piston chamber 432 may be defined within a collet body 708 coupled to or otherwise forming an integral part of the bullnose tip 702. The collet body 708 may define a plurality of axially extending fingers 710 (best seen in FIG. 7B) that are able to flex upon being forced radially outward. The collet body 708 further includes a radial protrusion 712 defined on the inner surface of the collet body 708 and otherwise extending radially inward from each of the axially extending fingers 710. The radial protrusion 712 may be configured to interact with a wedge member 713 defined on the outer surface of the second piston 428.

As the second piston 428 moves axially within the second piston chamber 432, it compresses a biasing device 716 arranged within the second piston chamber 432. The biasing device 716 may be a helical spring, a series of Belleville washers, an air shock, or the like. In some embodiments, the second piston 428 defines a cavity 718 that receives the biasing device 716 at least partially therein. The opposing end of the biasing device 716 may engage the inner end 720 of the bullnose tip 702, and compressing the biasing device 716 with the second piston 428 generates a spring force.

Moreover, as the second piston 428 moves axially within the second piston chamber 432, the wedge member 713 engages the radial protrusion 712 and forces the axially extending fingers 710 radially outward. This is seen in FIG. 7B. Once forced radially outward, the bullnose tip 702 effectively exhibits the second diameter 410*b*, as described above. To return to the default configuration, the process is reversed such that the spring force generated in the biasing device 716 is able to force the second piston 428 back within the second piston chamber 432 and thereby allow the axially extending fingers 710 to radially contract. As a result, the bullnose tip 702 is returned once again to the first diameter 410*a*.

The present disclosure also contemplates varying the length of the bullnose assemblies generally described herein using a movable bullnose tip instead of a movable sleeve member 406. More particularly, in some embodiments, the sleeve member 406 may be a stationary part or portion of the bullnose assembly and instead the axial position of the bullnose tip may be adjusted with respect to the sleeve member 406 in order to move between the default and actuated configurations described above. Accordingly, in such embodiments, actuating the bullnose assembly 400 of FIGS. 4A and 4B would serve to move the bullnose tip 404 with respect to the sleeve member 406 from the first length 408*a* to the second length 408*b*. As will be appreciated, similar actuating means may be employed in order to move the bullnose tip 404 with respect to the sleeve member 406. Such means include, but not limited to, using hydraulic pressure acting on a piston operatively coupled to the bullnose tip 404, an actuating device operatively coupled to the bullnose tip 404, and a pressure drop created across the bullnose assembly which forces a piston that is operatively coupled to the bullnose tip 404 to move.

Embodiments disclosed herein include:

A. A wellbore system including an upper deflector arranged within a main bore of a wellbore and defining first and second channels, a lower deflector arranged within the main bore and spaced from the upper deflector by a predetermined distance, the lower deflector defining a first conduit that exhibits a predetermined diameter and communicates with a lower portion of the main bore and a second conduit that communicates with a lateral bore, and a bullnose assembly including a body and a bullnose tip arranged at a distal end of the body, the bullnose assembly being actuatable between a default configuration and an actuated configuration, wherein the upper and lower deflectors direct the bullnose assembly into one of the lateral bore and the lower portion of the main bore based on a length and a diameter of the bullnose tip as compared to the predetermined distance and the predetermined diameter, respectively.

B. A method including introducing a bullnose assembly into a main bore of a wellbore, the bullnose assembly including a body and a bullnose tip arranged at a distal end of the body, and the bullnose assembly being actuatable between a default configuration and an actuated configuration, directing the bullnose assembly through an upper deflector arranged within the main bore and defining first and second channels, advancing the bullnose assembly to a lower deflector arranged within the main bore and spaced from the upper deflector by a predetermined distance, the lower deflector defining a first conduit that exhibits a predetermined diameter and communicates with a lower portion of the main bore and a second conduit that communicates with a lateral bore, and directing the bullnose assembly into one of the lateral bore and the lower portion of the main bore based on a length and a diameter of the bullnose tip as compared to the predetermined distance and the predetermined diameter, respectively.

C. A multilateral wellbore system including a main bore having a first junction and a second junction spaced downhole from the first junction, a first deflector assembly arranged at the first junction and comprising a first upper deflector and a first lower deflector spaced from the first upper deflector by a predetermined distance, the first lower deflector defining a first conduit that exhibits a predetermined diameter and communicates with a first lower portion of the main bore and a second conduit that communicates with a first lateral bore, a second deflector assembly arranged at the second junction and comprising a second upper deflector and a second lower deflector spaced from the second upper deflector by the predetermined distance, the second lower deflector defining a third conduit that exhibits the predetermined diameter and communicates with a second lower portion of the main bore and a fourth conduit that communicates with a second lateral bore, and a bullnose assembly including a body and a bullnose tip arranged at a distal end of the body, the bullnose assembly being actuatable between a default configuration and an actuated configuration, wherein the first and second deflector assemblies are configured to direct the bullnose assembly into one of the first and second lateral bores and the first and second lower portions of the main bore based on a length and a diameter of the bullnose tip as compared to the predetermined distance and the predetermined diameter, respectively.

Each of embodiments A, B, and C may have one or more of the following additional elements in any combination: Element 1: wherein the bullnose assembly further comprises a sleeve member movably arranged about the body in order to vary the length of the bullnose tip. Element 2: wherein the bullnose assembly is actuatable to vary the length of the bullnose tip by using at least one of hydraulic pressure acting on a piston operatively coupled to the sleeve member, an actuating device operatively coupled to the sleeve member, and a pressure drop created across the bullnose assembly which forces a piston that is operatively coupled to the sleeve member to move. Element 3: wherein, when the bullnose assembly is in the default configuration, the length of the bullnose tip is greater than the predetermined distance and the diameter of the bullnose tip is less than the predetermined diameter, whereby the bullnose assembly is able to be directed into the first conduit. Element 4: wherein, when the bullnose assembly is in the actuated configuration, the length of the bullnose tip is less than the predetermined distance and the diameter of the bullnose tip is greater than the predetermined diameter, whereby the bullnose assembly is able to be directed into the second conduit. Element 5: wherein the lower deflector defines a ramped surface that forms part of the second conduit, the ramped surface being configured to guide the bullnose assembly in the actuated configuration to the second conduit. Element 6: wherein the bullnose assembly further includes piston movably arranged within a piston chamber defined within the bullnose tip, a wedge member operatively coupled to the piston such that movement of the piston correspondingly moves the wedge member, and a coil arranged about the bullnose tip and in contact with the wedge member, the piston being actuatable such that the wedge member is moved to radially expand the coil, wherein, when the coil is radially expanded, the diameter of the bullnose tip exceeds the predetermined diameter. Element 7: wherein the bullnose assembly further includes a collet body forming at least part of the bullnose tip and defining a plurality of axially extending fingers, a radial protrusion defined on an inner surface of the collet body and extending radially inward from each axially extending finger, and a piston movably arranged within a piston chamber defined within the collet body and having a wedge member defined on an outer surface thereof, the piston being actuatable such that the wedge member engages the radial protrusion and forces the plurality of axially extending fingers radially outward such that the diameter of the bullnose tip exceeds the predetermined diameter.

Element 8: further comprising actuating the bullnose assembly between the default configuration, where the length of the bullnose tip is greater than the predetermined distance and the diameter of the bullnose tip is less than the predetermined diameter, and the actuated configuration, where the length of the bullnose tip is less than the predetermined distance and the diameter of the bullnose tip is greater than the predetermined diameter. Element 9: further comprising directing the bullnose assembly into the first conduit when the bullnose assembly is in the default configuration. Element 10: further comprising directing the bullnose assembly into the second conduit when the bullnose assembly is in the actuated configuration. Element 11: further comprising engaging the bullnose tip on a ramped surface forming part of the lower deflector, and guiding the bullnose tip into the second conduit and the lateral bore with the ramped surface. Element 12: wherein the bullnose assembly further comprises a sleeve member movably arranged about the body in order to vary the length of the bullnose tip, and wherein actuating the bullnose assembly between the default configuration and the actuated configuration further comprises using at least one of hydraulic pressure acting on a piston operatively coupled to the sleeve member, an actuating device operatively coupled to the sleeve member, and a pressure drop created across the bullnose assembly which forces a piston that is operatively coupled to the sleeve member to move. Element 13: wherein actuating the bullnose assembly comprises moving a piston arranged within a piston chamber defined within the bullnose tip and thereby moving a wedge member operatively coupled to the piston, and engaging a coil arranged about the bullnose tip with the wedge member and forcing the coil to radially expand, wherein, when the coil is radially expanded, the diameter of the bullnose tip is greater than the predetermined diameter. Element 14: wherein actuating the bullnose assembly comprises moving a piston arranged within a piston chamber defined within a collet body that forms at least part of the bullnose tip, the collet body defining a plurality of axially extending fingers, moving a wedge member defined on an outer surface of the piston into engagement with a radial protrusion defined on an inner surface of the collet body and extending radially inward from each axially extending finger, and forcing the plurality of axially extending fingers radially outward with the wedge member, wherein, when the plurality of axially extending fingers is forced radially outward, the diameter of the bullnose tip exceeds the predetermined diameter.

Element 15: wherein, when the bullnose assembly is in the default configuration, the length of the bullnose tip is greater than the predetermined distance and the diameter of the bullnose tip is less than the predetermined diameter, whereby the bullnose assembly is able to be directed into the first and third conduits. Element 16: wherein, when the bullnose assembly is in the actuated configuration, the length of the bullnose tip is less than the predetermined distance and the diameter of the bullnose tip is greater than the predetermined diameter, whereby the bullnose assembly is able to be directed into the second and fourth conduits. Element 17: wherein each of the first and second lower deflectors defines a ramped surface that forms part of the second and fourth conduits, respectively, the ramped surface being configured to guide the bullnose assembly in the actuated configuration to the second and fourth conduits. Element 18: wherein the bullnose assembly further comprises a sleeve member movably arranged about the body in order to vary the length of the bullnose tip, and wherein the bullnose assembly is actuatable using at least one of hydraulic pressure acting on a piston operatively coupled to the sleeve member, an actuating device operatively coupled to the sleeve member, and a pressure drop created across the bullnose assembly which forces a piston that is operatively coupled to the sleeve member to move.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A wellbore system, comprising:

an upper deflector arranged within a main bore of a wellbore and defining first and second channels;

a lower deflector arranged within the main bore and spaced from the upper deflector by a predetermined distance, the lower deflector defining a first conduit that exhibits a predetermined diameter and communicates with a lower portion of the main bore and a second conduit that communicates with a lateral bore; and a bullnose assembly including a body and a bullnose tip arranged at a distal end of the body, the bullnose assembly being actuatable between a default configuration and an actuated configuration to vary a length and a diameter of the bullnose tip, wherein the upper and lower deflectors direct the bullnose assembly into one of the lateral bore and the lower portion of the main bore based on the length and the diameter of the bullnose tip as compared to the predetermined distance and the predetermined diameter, respectively.

2. The wellbore system of claim 1, wherein the bullnose assembly further comprises a sleeve member movably arranged about the body in order to vary the length of the bullnose tip.

3. The wellbore system of claim 2, wherein the bullnose assembly is actuatable to vary the length of the bullnose tip by using at least one of hydraulic pressure acting on a piston operatively coupled to the sleeve member, an actuating device operatively coupled to the sleeve member, and a pressure drop created across the bullnose assembly which forces a piston that is operatively coupled to the sleeve member to move.

4. The wellbore system of claim 1, wherein the bullnose assembly is in the default configuration and the length of the bullnose tip is greater than the predetermined distance and the diameter of the bullnose tip is less than the predetermined diameter, whereby the bullnose assembly is directed into the first conduit.

5. The wellbore system of claim 1, wherein the bullnose assembly is in the actuated configuration and the length of the bullnose tip is less than the predetermined distance and the diameter of the bullnose tip is greater than the predetermined diameter, whereby the bullnose assembly is directed into the second conduit.

6. The wellbore system of claim 5, wherein the lower deflector defines a ramped surface that forms part of the second conduit, the ramped surface being configured to guide the bullnose assembly in the actuated configuration to the second conduit.

7. The wellbore system of claim 1, wherein the bullnose assembly further includes:

a piston movably arranged within a piston chamber defined within the bullnose tip;

a wedge member operatively coupled to the piston such that movement of the piston correspondingly moves the wedge member; and a coil arranged about the bullnose tip and in contact with the wedge member, the piston being actuatable such that the wedge member is moved to radially expand the coil and thereby increase the diameter of the bullnose tip to exceed the predetermined diameter.

8. The wellbore system of claim 1, wherein the bullnose assembly further includes:

a collet body forming at least part of the bullnose tip and defining a plurality of axially extending fingers;

a radial protrusion defined on an inner surface of the collet body and extending radially inward from each axially extending finger; and a piston movably arranged within a piston chamber defined within the collet body and having a wedge member defined on an outer surface thereof, the piston being actuatable such that the wedge member engages the radial protrusion and forces the plurality of axially extending fingers radially outward such that the diameter of the bullnose tip exceeds the predetermined diameter.

9. A method, comprising:

introducing a bullnose assembly into a main bore of a wellbore, the bullnose assembly including a body and a bullnose tip arranged at a distal end of the body, and the bullnose assembly being actuatable between a default configuration and an actuated configuration to vary a length and a diameter of the bullnose tip;

directing the bullnose assembly through an upper deflector arranged within the main bore and defining first and second channels;

advancing the bullnose assembly to a lower deflector arranged within the main bore and spaced from the upper deflector by a predetermined distance, the lower deflector defining a first conduit that exhibits a predetermined diameter and communicates with a lower portion of the main bore and a second conduit that communicates with a lateral bore; and directing the bullnose assembly into one of the lateral bore and the lower portion of the main bore based on a length and a diameter of the bullnose tip as compared to the predetermined distance and the predetermined diameter, respectively.

10. The method of claim 9, further comprising actuating the bullnose assembly between the default configuration, where the length of the bullnose tip is greater than the predetermined distance and the diameter of the bullnose tip is less than the predetermined diameter, and the actuated configuration, where the length of the bullnose tip is less than the predetermined distance and the diameter of the bullnose tip is greater than the predetermined diameter.

11. The method of claim 10, further comprising directing the bullnose assembly into the first conduit with the bullnose assembly in the default configuration.

12. The method of claim 10, further comprising directing the bullnose assembly into the second conduit with the bullnose assembly in the actuated configuration.

13. The method of claim 12, further comprising:

engaging the bullnose tip on a ramped surface forming part of the lower deflector; and guiding the bullnose tip into the second conduit and the lateral bore with the ramped surface.

14. The method of claim 10, wherein the bullnose assembly further comprises a sleeve member movably arranged about the body in order to vary the length of the bullnose tip, and wherein actuating the bullnose assembly between the default configuration and the actuated configuration further comprises using at least one of hydraulic pressure acting on a piston operatively coupled to the sleeve member, an actuating device operatively coupled to the sleeve member, and a pressure drop created across the bullnose assembly which forces a piston that is operatively coupled to the sleeve member to move.

15. The method of claim 10, wherein actuating the bullnose assembly comprises:

moving a piston arranged within a piston chamber defined within the bullnose tip and thereby moving a wedge member operatively coupled to the piston; and engaging a coil arranged about the bullnose tip with the wedge member and forcing the coil to radially expand and thereby increase the diameter of the bullnose tip to exceed the predetermined diameter.

16. The method of claim 10, wherein actuating the bullnose assembly comprises:

moving a piston arranged within a piston chamber defined within a collet body that forms at least part of the bullnose tip, the collet body defining a plurality of axially extending fingers;

moving a wedge member defined on an outer surface of the piston into engagement with a radial protrusion defined on an inner surface of the collet body and extending radially inward from each axially extending finger; and forcing the plurality of axially extending fingers radially outward with the wedge member and thereby increasing the diameter of the bullnose tip to exceed the predetermined diameter.

17. A multilateral wellbore system, comprising:

a main bore having a first junction and a second junction spaced downhole from the first junction;

a first deflector assembly arranged at the first junction and comprising a first upper deflector and a first lower deflector spaced from the first upper deflector by a predetermined distance, the first lower deflector defining a first conduit that exhibits a predetermined diameter and communicates with a first lower portion of the main bore and a second conduit that communicates with a first lateral bore;

a second deflector assembly arranged at the second junction and comprising a second upper deflector and a second lower deflector spaced from the second upper deflector by the predetermined distance, the second lower deflector defining a third conduit that exhibits the predetermined diameter and communicates with a second lower portion of the main bore and a fourth conduit that communicates with a second lateral bore; and a bullnose assembly including a body and a bullnose tip arranged at a distal end of the body, the bullnose assembly being actuatable between a default configuration and an actuated configuration, wherein the first and second deflector assemblies are configured to direct the bullnose assembly into one of the first and second lateral bores and the first and second lower portions of the main bore based on a length and a diameter of the bullnose tip as compared to the predetermined distance and the predetermined diameter, respectively.

18. The multilateral wellbore system of claim 17, wherein the bullnose assembly is in the default configuration and the length of the bullnose tip is greater than the predetermined distance and the diameter of the bullnose tip is less than the predetermined diameter, whereby the bullnose assembly is directed into the first and third conduits.

19. The multilateral wellbore system of claim 17, wherein the bullnose assembly is in the actuated configuration and the length of the bullnose tip is less than the predetermined distance and the diameter of the bullnose tip is greater than the predetermined diameter, whereby the bullnose assembly is directed into the second and fourth conduits.

20. The multilateral wellbore system of claim 19, wherein each of the first and second lower deflectors defines a ramped surface that forms part of the second and fourth conduits, respectively, the ramped surface being configured to guide the bullnose assembly in the actuated configuration to the second and fourth conduits.

21. The multilateral wellbore system of claim 17, wherein the bullnose assembly further comprises a sleeve member movably arranged about the body in order to vary the length of the bullnose tip, and wherein the bullnose assembly is actuatable using at least one of hydraulic pressure acting on a piston operatively coupled to the sleeve member, an actuating device operatively coupled to the sleeve member, and a pressure drop created across the bullnose assembly which forces a piston that is operatively coupled to the sleeve member to move.

* * * * *